US005551847A

United States Patent [19]

Gardner et al.

[11] Patent Number: 5,551,847

[45] Date of Patent: Sep. 3, 1996

[54] LOST MOTION PILOT VALVE FOR DIAPHRAGM PUMP

[75] Inventors: Richard K. Gardner, Montpelier; Robert J. Knecht, Edgerton, both of Ohio

[73] Assignee: Ingersoll-Rand Company, Woodcliff Lake, N.J.

[21] Appl. No.: 427,542

[22] Filed: Apr. 24, 1995

[51] Int. Cl.[6] ..... F04B 35/02

[52] U.S. Cl. ..... 417/393; 251/77; 91/309; 91/314

[58] Field of Search ..... 417/393, 395; 251/77, 319; 91/309, 313, 314

[56] References Cited

U.S. PATENT DOCUMENTS

| | | | |
|---|---|---|---|
| 545,368 | 8/1895 | Miller | 91/314 |
| 3,791,768 | 2/1974 | Wanner | 417/395 |
| 4,854,832 | 8/1989 | Gardner et al. | 417/393 |
| 5,232,352 | 8/1993 | Robinson | 91/309 |
| 5,470,209 | 11/1995 | Hartley et al. | 417/395 |

*Primary Examiner*—Timothy S. Thorpe
*Assistant Examiner*—Roland G. McAndrews, Jr.
*Attorney, Agent, or Firm*—Walter C. Vliet

[57] ABSTRACT

A mechanical shift pilot valve is provided with lost motion response to accommodate slight piston reversals at travel limits to prevent a false shift signal related thereto.

2 Claims, 1 Drawing Sheet

LOST MOTION PILOT VALVE FOR DIAPHRAGM PUMP

BACKGROUND OF THE INVENTION

This invention relates generally to mechanical shift, pneumatic assist pilot valves for diaphragm pumps and the like and more particularly to a lost motion device for stabilizing the mechanical shift of such valves.

U.S. Pat. No. 4,854,832 issued to Richard K. Gardner (co-inventor herein) and Nicholas Kozumplik Jr. and assigned to The Aro Corporation (common Assignee herein) discloses a mechanical shift, pneumatic assist pilot valve for use in diaphragm pumps. Briefly that invention comprises a combined mechanical shifting mechanism and pneumatic pilot valve construction to control the cycling of a double diaphragm pump. The mechanical cycling or shifting mechanism is positioned between pressure chambers of the diaphragm pump in the pump housing and extends axially into one or the other pressure chamber.

The shifting mechanism moves axially in response to engagement by one of the pump diaphragms. Upon engagement by a diaphragm, the mechanical shift opens fluid pressure passageways to a pneumatic pilot valve which controls fluid flow to the respective pressure chambers associated with the diaphragm pump. A positive pilot signal is thus supplied through the entire stroke or cycle of the diaphragm pump. The mechanical shifting mechanism is not connected directly to a diaphragm or to the connecting rod which connects the diaphragms.

In the operation of diaphragm pumps it is not uncommon to have air drawn into the fluid chamber of the pump along with the pumped fluid. The air is compressed during the pumping of the fluid and during shifting of the air valve may expand to cause the diaphragm to back up slightly. Due to the pump dynamics, fluid pressure may also be momentarily higher than air pressure. This allows the pilot rod to also back up and shut the signal off to shift the main valve. This may cause the pump to stutter and in some instances stop or stall.

The foregoing illustrates limitations known to exist in present devices and methods. Thus it is apparent that it would be advantageous to provide an alternative directed to overcoming one or more of the limitations set forth above. Accordingly a suitable alternative is provided including features more fully disclosed hereinafter.

SUMMARY OF THE INVENTION

In one aspect of the present invention the object of the invention is accomplished by providing a lost motion pilot valve for a diaphragm pump including a mechanical shift pilot valve shiftable in response to diaphragm position, and lost motion means operatively associated with the pilot valve for delaying or retaining a pilot signal initiated by the diaphragm position.

The foregoing and other aspects will become apparent from the following detailed description of the invention when considered in conjunction with the accompanying drawing figures.

BRIEF DESCRIPTION OF THE DRAWING FIGURES

FIG. 1 is a simplified cross sectional view of a diaphragm pump including a lost motion mechanical shift pilot valve according to the present invention; and FIG. 2 is an elevation view of a spool mechanical shift pilot valve incorporating the lost motion device of the present invention.

DETAILED DESCRIPTION

Figure 1:
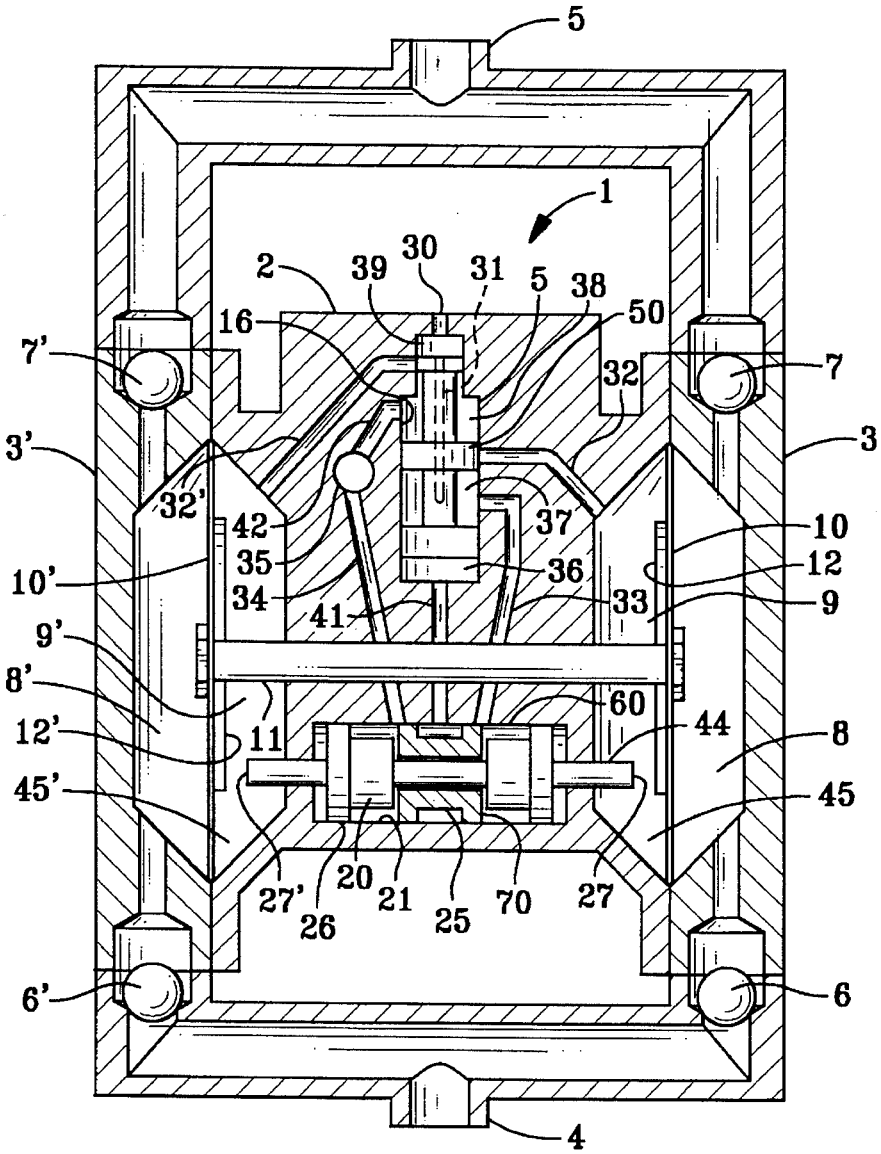

Referring to FIG. 1, a double diaphragm pump incorporating the present invention is generally shown and designated by the reference numeral 1. The pump is comprised of a main body 2, two diaphragm end caps 3 and 3', an inlet manifold 4, and a discharge manifold 5. Formed within the body are two motive fluid chambers 45 and 45'. Also formed within the diaphragm end caps are two pumped fluid chambers 8 and 8'. The motive fluid chamber 45 and 45' and the pumped fluid chambers 8 and 8' are separated by a flexible diaphragm 10 and 10'. The diaphragms 10 and 10' are provided with a backing plate 12 and 12' respectively and coordinated in reciprocating movement by tie rod 11 in a manner well known in the construction of double diaphragm pumps.

The reciprocating movement of the diaphragm as controlled by motive fluid in the motive fluid chambers 45, 45' produces the pumping action which causes the pumped fluid from the inlet manifold 4 to alternately pass inlet ball check 6 and 6' and thereafter to be forced out alternately past outlet ball check 7 and 7' into the discharge feed manifold 5. The reciprocating action of the diaphragm is accomplished by means of pressurized air or the like being applied in the motive fluid chambers by alternate supply and exhaust through a main air supply spool valve 50. Operation of the main spool valve 50 may be summarized as follows:

A three land spool 50 is disposed within a stepped bore 16 for reciprocation therein between an upper and lower position as viewed in FIG. 1. The three piston lands divide the stepped bore 16 into four operating chambers which may be further described as follows:

Chamber 36, when pressurized, causes the spool 50 to be displaced vertically upward. Chamber 37 is a constant air supply chamber which moves with the spool. Chamber 38 is a constant exhaust chamber which also moves with the spool, and chamber 39 is a constant pressurized biasing chamber which tends to displace the spool in a downward direction and also forms a source of air supply to the left hand motive fluid chamber 45'. Air or pressure fluid is supplied to chamber 39 via air supply port 30 and is further transferred to chamber 37 by means of a spool passage 31 in order to provide a constant supply of pressurized fluid or air to chamber 37.

The position of the main valve 50 further determines the alternate supply and exhaust of pressure fluid to the motive fluid chambers 45 and 45' via passage 32 and 32' respectively. When the main valve spool 50 is in the lower position, the left hand motive fluid chamber 45' is pressurized by air via ports 30 and 32'. At the same time motive fluid chamber 45 is being exhausted via passageway 32 and passageway 42 to exhaust port 35. Conversely, when the spool is in the upper position, the function is reversed with air being supplied to the motive chamber 45 via air supply port 30, spool passage 31 and supply passage 32 while the left hand motive fluid chamber is being exhausted via passageway 32' and 42 to the exhaust port 35.

The position of the main spool 50 is determined according to the present invention by a mechanically shifted pilot valve generally designated by the reference numeral 60. The pilot valve is disposed in a spool bore 21. The pilot spool 20 is comprised of a pair of pistons 26 and 26' spaced apart and disposed for reciprocation on a spool rod 44. The spool rod 44 extends into each of the motive fluid chambers to form contact tips 27 and 27' which cooperate with the diaphragm backing plates 12 and 12' at the alternating inward stroke limits of the diaphragm. Contact with the diaphragm backing plates causes the pilot spool to initiate movement of the pilot spool and reversal of the pressurizing process.

According to the present invention the pilot valve is further provided with a lost motion spool 25 which is disposed about the spool rod 44 intermediate the spool piston ends 26 and 26'. A lost motion gap 70 is provided between the lost motion spool 25 and the outer spool ends 26 and 26'.

Figure 2:
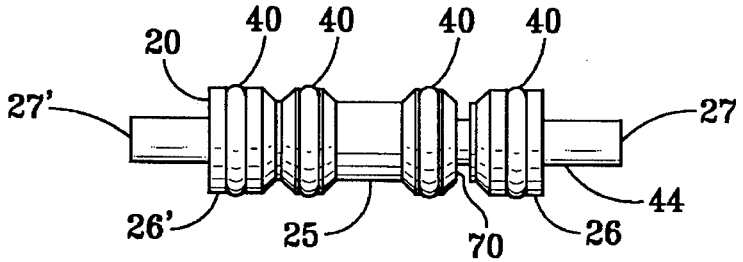

This invention adds lost motion to the pilot piston rod, by making a lost motion inner and a reciprocating outer piston which are not connected. This allows the outer piston to move, or backup a limited amount as determined by gap 70 without effecting the pilot signal which is controlled by the inner piston. This allows enough time for the main valve to supply the signal which completes the pilot valve shift. Also this provides a better seal as it allows two seals for each piston. The four seals 40 are best seen on FIG. 2.

The inner spool (lost motion spool 25) controls the position of the main valve 50 by supplying air from chamber 37 to chamber 36 via passage 33 and 41 or in the left position exhausting chamber 36 via passageways 36 and 34.

In summary of operation, air entering inlet 30 forces the main spool 50 down which connects air supply to the left diaphragm 10', and connects the main exhaust 35 to right diaphragm 10'. Air forces the right diaphragm to the right and the pilot rod 44 to the left, which connects the bottom (chamber 36) of the main valve to exhaust. The right diaphragm pulls the left diaphragm to the right contacting the pilot rod and pushes it to the right, only the end seals 26, 26' move for a set distance (lost motion) until the left end contacts the inner spool 25 and moves it to the right. This shuts off the pilot exhaust and opens air supply to the bottom of the main valve forcing it upward. This switches the main air supply to the left and opens the right diaphragm to exhaust. Air now forces the left diaphragm to the left.

If for some reason the fluid pressure and/or exhaust pressure causes the diaphragm to back up, the pilot signals could be lost or reversed. This will not happen with the present invention since only the outer spool will move and the inner spool will maintain the signal. After the shift, the air forcing the left diaphragm to the left will also force both the outer and inner pilot spools to the right maintaining the signal throughout the stroke until the right diaphragm is pulled into the pilot rod 44 returning it to the original position allowing the bottom of the main valve to be vented to exhaust allowing air to return it to the original position.

For purposes of assembly it has been found that the pilot rod 44 may be split to permit the seals 26 and 26' to separate in operation and for assembly while maintaining the lost motion gap on convergence.

Having described our invention in terms of a preferred embodiment we do not wish to be limited in the scope of the invention except as claimed.

What is claimed is:

1. A pilot valve for a diaphragm pump comprising:

a mechanical shift spool valve shiftable in response to diaphragm position, and lost motion means operatively associated with said pilot valve for delaying or retaining a pilot signal initiated by said diaphragm position.

2. A pilot valve for a diaphragm pump according to claim 1 wherein: said spool valve is further comprised of a first and a second piston end in sealing contact with a spool bore and spaced apart by a spool rod;

each of said pistons being further provided with diaphragm contact tips for activation in response to a position of a first and second diaphragm; and a lost motion spool having first and second sealing ends in sealing contact with said spool bore disposed in sliding contact on said spool rod intermediate said first and said second piston ends with a lost motion clearance therebetween.

* * * * *